US010505305B2

(12) United States Patent
Liao

(10) Patent No.: US 10,505,305 B2
(45) Date of Patent: Dec. 10, 2019

(54) SECUREMENT OF SOLDER UNIT UPON CONTACT

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Fang-Jwu Liao, New Taipei (TW)

(73) Assignees: FU DING PRECISION COMPONENT (SHEN ZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/170,023

(22) Filed: Oct. 24, 2018

(65) Prior Publication Data

US 2019/0123469 A1 Apr. 25, 2019

(30) Foreign Application Priority Data

Oct. 24, 2017 (CN) ..... 2017 2 1380836
Oct. 24, 2017 (CN) ..... 2017 2 1384671
Oct. 24, 2017 (CN) ..... 2017 2 1387052

(51) Int. Cl.
*H01R 13/193* (2006.01)
*H01R 4/02* (2006.01)

(52) U.S. Cl.
CPC ..... *H01R 13/193* (2013.01); *H01R 4/02* (2013.01); *H01R 4/024* (2013.01)

(58) Field of Classification Search
CPC ..... H01R 13/193; H01R 4/02; H01R 12/707; H01R 4/07; H01R 4/027; H01R 4/028; H01R 4/024
See application file for complete search history.

(56) References Cited

U.S. PATENT DOCUMENTS 6,095,842 A 8/2000 Hai
6,099,321 A 8/2000 Hai
6,267,615 B1 7/2001 Hai
6,702,594 B2 * 3/2004 Lee ..... H01R 4/028 439/70
6,969,286 B1 * 11/2005 Mongold ..... H01R 12/57 439/874

(Continued)

FOREIGN PATENT DOCUMENTS

CN 2643493 Y 9/2004

*Primary Examiner* — Briggitte R. Hammond
(74) *Attorney, Agent, or Firm* — Wei Te Chung; Ming Chieh Chang

(57) ABSTRACT

An electrical contact forms opposite top surface and bottom surface. A guiding groove is formed in the top surface. A mounting section is formed at an end of the contact. In the mounting section, a securing hole extends downwardly from the guiding groove and through the bottom surface. A solder unit is received within the securing hole and reaches a conductive pad, under the contact, to which the contact is soldered by reflowing the solder unit. The guiding groove extends from an oblique section of the contact so as to assure the socket unit can be smoothly dropped into the securing hole. The solder unit can be temporarily retained within the securing hole before reflowing.

20 Claims, 15 Drawing Sheets

(56) References Cited

U.S. PATENT DOCUMENTS

| | | | | |
|---|---|---|---|---|
| 8,894,423 | B2 * | 11/2014 | Mongold | H01R 13/428 439/83 |
| 2003/0013330 | A1 * | 1/2003 | Takeuchi | H01R 12/57 439/83 |
| 2006/0258190 | A1 * | 11/2006 | Chen | H05K 3/3426 439/83 |
| 2006/0258191 | A1 * | 11/2006 | Chen | H05K 3/3426 439/83 |
| 2008/0108255 | A1 * | 5/2008 | Peloza | B23K 1/0008 439/876 |
| 2010/0216322 | A1 * | 8/2010 | Fan | H01R 12/58 439/83 |
| 2012/0252274 | A1 * | 10/2012 | Ju | H01R 12/716 439/626 |
| 2014/0174821 | A1 * | 6/2014 | Pao | H01R 43/02 174/75 R |
| 2014/0174823 | A1 * | 6/2014 | Pao | H01R 12/57 174/84 C |

* cited by examiner

SECUREMENT OF SOLDER UNIT UPON CONTACT

BACKGROUND OF THE DISCLOSURE

1. Field of the Disclosure

The present disclosure relates to the electronic part and the connecting part with the solder unit thereon.

2. Description of Related Arts

The traditional contact equipped with a solder ball can be referred to U.S. Pat. Nos. 6,095,842 and 6,099,321 wherein the undersurface of the contact tail is coated with a layer of solder flux, and the solder unit/ball is attached upon the undersurface of the contact tail via assistance of the solder flux. Anyhow, such arrangement may have defects including contamination of the solder flux upon the contacting section of the contact, and/or the poor securement between the solder unit and the contact tail.

An improved solder unit securement upon the contact tail is desired.

SUMMARY OF THE DISCLOSURE

Accordingly, an object of the present disclosure is to provide an improved securement of the solder unit upon the contact tail.

An electrical contact forms opposite top surface and bottom surface. A guiding groove is formed in the top surface. A mounting section is formed at an end of the contact. In the mounting section, a securing hole extends downwardly from the guiding groove and through the bottom surface. A solder unit is received within the securing hole and reaches a conductive pad, under the contact, to which the contact is soldered by reflowing the solder unit. The guiding groove extends from an oblique section of the contact so as to assure the socket unit can be smoothly dropped into the securing hole. The solder unit can be temporarily retained within the securing hole before reflowing. Another approach is to provide a receiving space in the mounting section wherein the receiving space extends through an end edge of the mounting section. A fixing peg extends in the receiving space. The solder unit is assembled to the mounting section from the end edge of the mounting section and grasps the fixing peg and is received within the receiving space. Yet, another approach is to have the solder unit have the annular groove to receive the pair of wings around the securing hole for being retained in the vertical direction wherein the solder unit is also assembled into the receiving space from the end edge of the mounting section.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
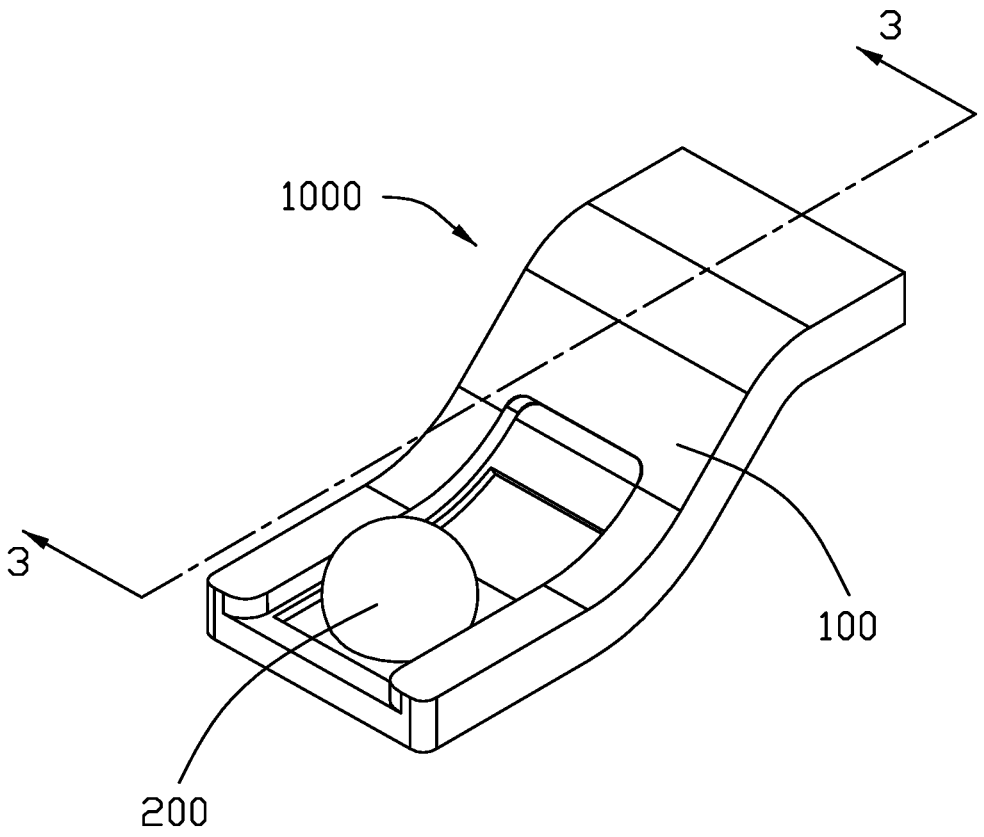
FIG. 1 is an assembled perspective view of the contact and the solder unit thereon according to the first embodiment of the invention.

Reference description will now be made in detail to the embodiment of the present disclosure. The reference numerals are only referred to the related embodiments, respectively.

Figure 2:
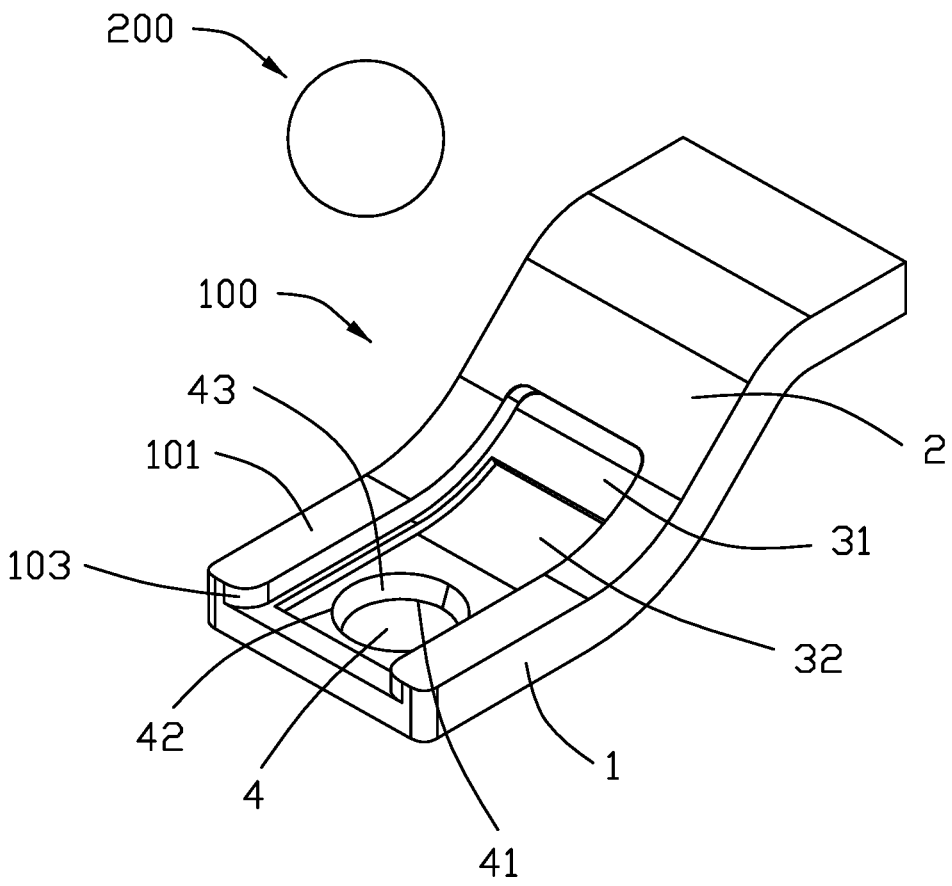
FIG. 2 is an exploded perspective view of the contact and the solder unit of FIG. 1.
Figure 3:
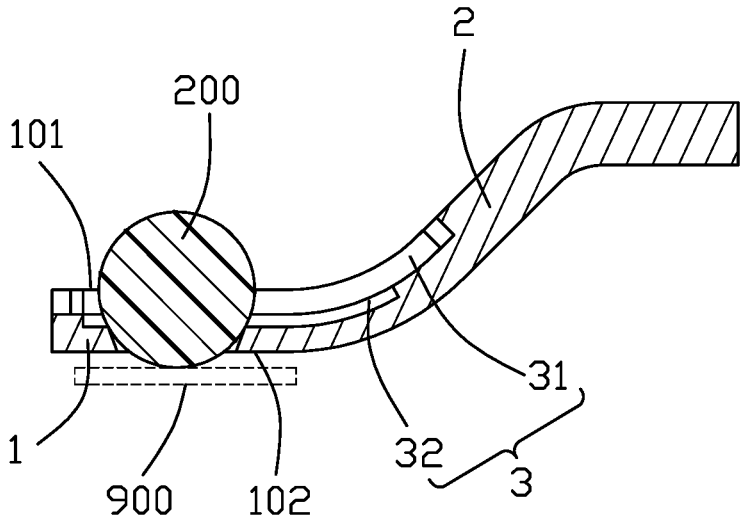
FIG. 3 is a cross-sectional view of the contact and the solder unit of FIG. 1.

Referring to FIGS. 1-3, a securing mechanism 1000 between the contact and the solder unit includes an electrical contact 100 and a metallic solder unit 200 which will be melted to reach a conductive pad 900 of an electrical part (not shown) under the contact 100 for securing the contact 100 and the conductive pad 900 together. The contact 100 has a top surface 101 and a bottom surface 102 opposite to each other in the vertical direction A front end face 103 is formed at the front end of the contact 100. The contact 100 includes a mounting section 1 and a resilient section 2 along the front-to-back direction. The mounting section 1 extends horizontally while the resilient section 2 extends curvedly and obliquely. A guiding groove 3 is downwardly recessed from the top surface 101, and a securing hole 4 extends from the guiding groove 3 and through the bottom surface 102. The guiding groove 3 extends through the front end face 103. The solder unit 200 is received within the securing hole 4 in an interference fit and extends beyond both the top surface 101 and the bottom surface 102. Understandably, during reflowing the melted solder unit 200 will be guided within the guiding groove 3 without risks of splashing.

The guiding groove 3 includes a first groove 31 downwardly recessed from the top surface 101, and a second groove 32 downwardly communicatively recessed below the first groove 31 wherein the first groove 31 is of a U-shaped configuration and the second groove 32 is of rectangular configuration. The first groove 31 extends through the front end surface 103 while the second groove 32 does not. Both the first groove 31 and the second groove 32 do not extend through the bottom surface 103. The second groove 32 is smaller than the first groove 31 in a top view. The first groove 31 and the second groove 32 both are formed in the top surface 101 of the mounting section 1 and the resilient section 2. The securing hole 4 is located in the mounting section 1 and adjacent to the front end surface 103, and forms an upper periphery 41 and a lower periphery 42 wherein the upper periphery 41 is larger than the lower periphery 42 with an oblique section 43 therebetween. The diameter of the solder unit 200 is larger than the upper periphery 41.

Figure 4:
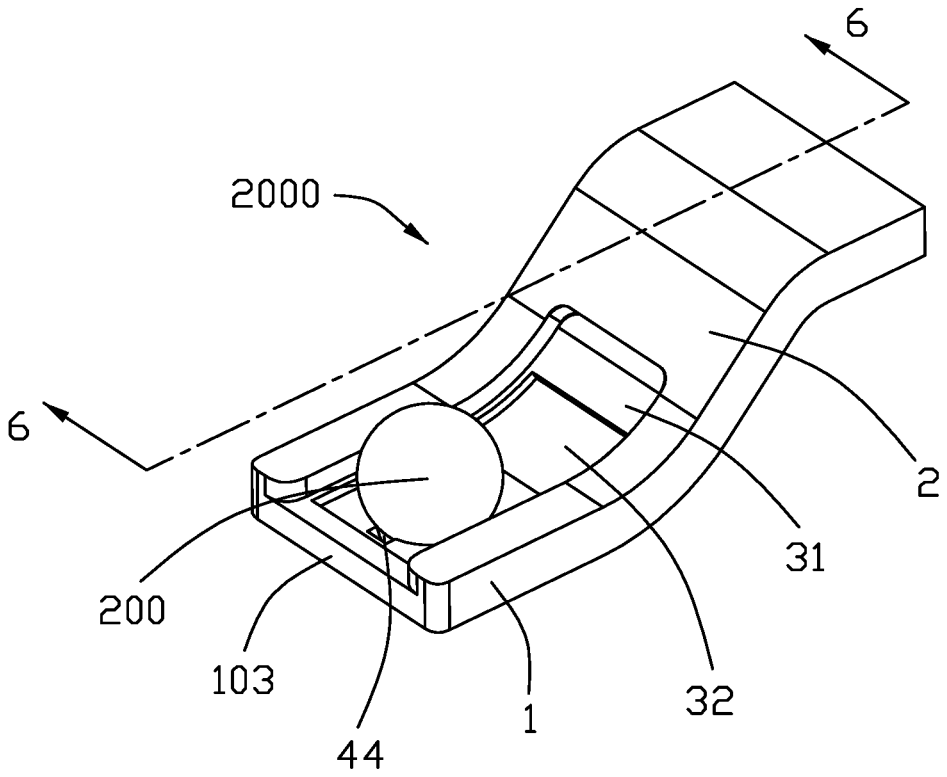
FIG. 4 is an assembled perspective view of the contact and the solder unit according to a second embodiment of the invention.
Figure 5:
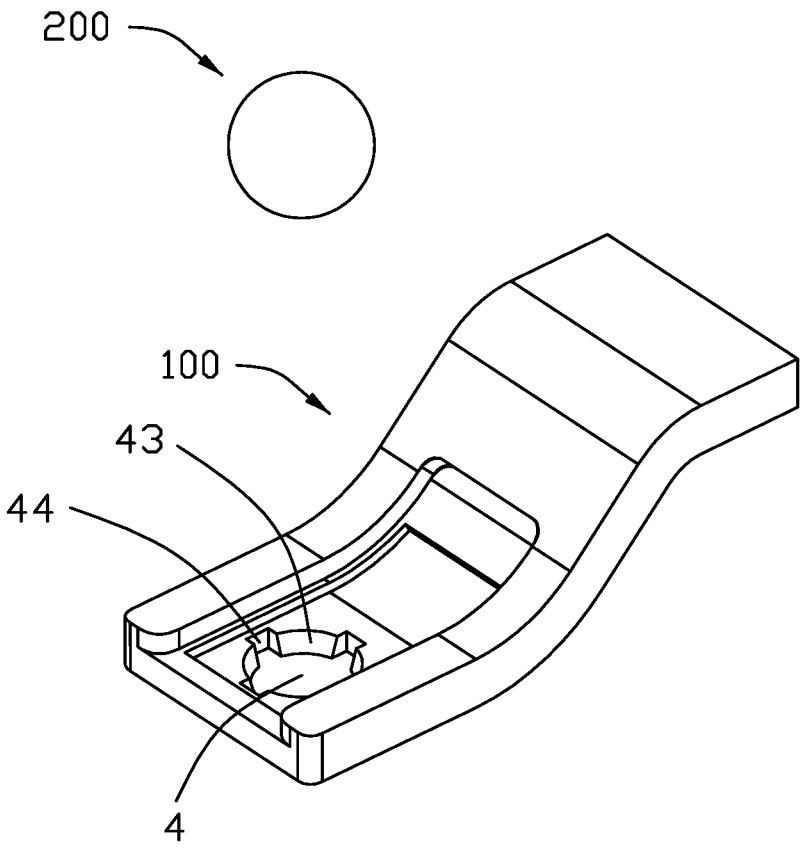
FIG. 5 is an exploded perspective view of the contact and the solder unit of FIG. 4.
Figure 6:
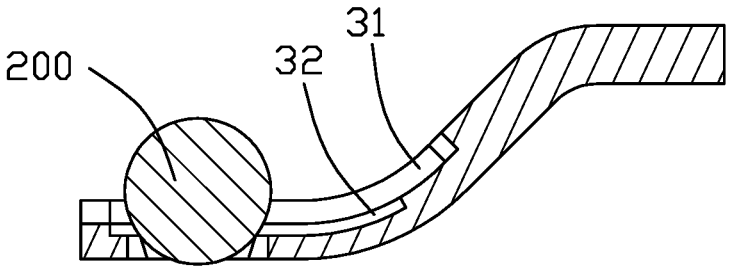
FIG. 6 is a cross-sectional view of the contact and the solder unit of FIG. 4.

Referring to FIGS. 4-6 showing the second embodiment, the securing mechanism 2000 discloses four notches 44 surrounding the securing hole 4. The notches may facilitate reflowing of the solder unit 200. In brief, in both first and second embodiments on one hand, the guiding groove 3 may assure lodging of the solder unit 200 into the securing hole 4; on the other hand, the securing hole 4 may restrain the deformation of the solder unit 200 during reflowing for assuring the proper configuration of the solidified solder unit 200 after reflowing. Understandably, the solder unit 200 is partially received within the securing hole 4 with a slight retention.

Figure 7:
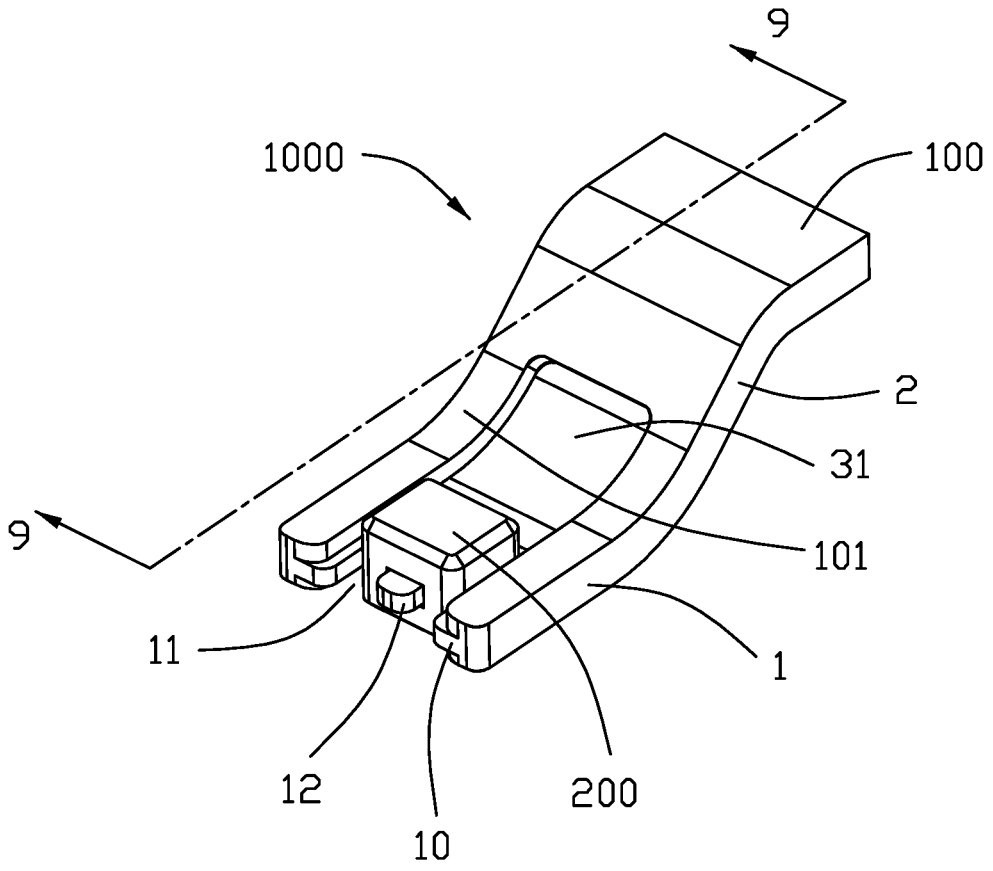
FIG. 7 is an assembled perspective view of the contact and the solder unit according to a third embodiment of the invention.
Figure 8:
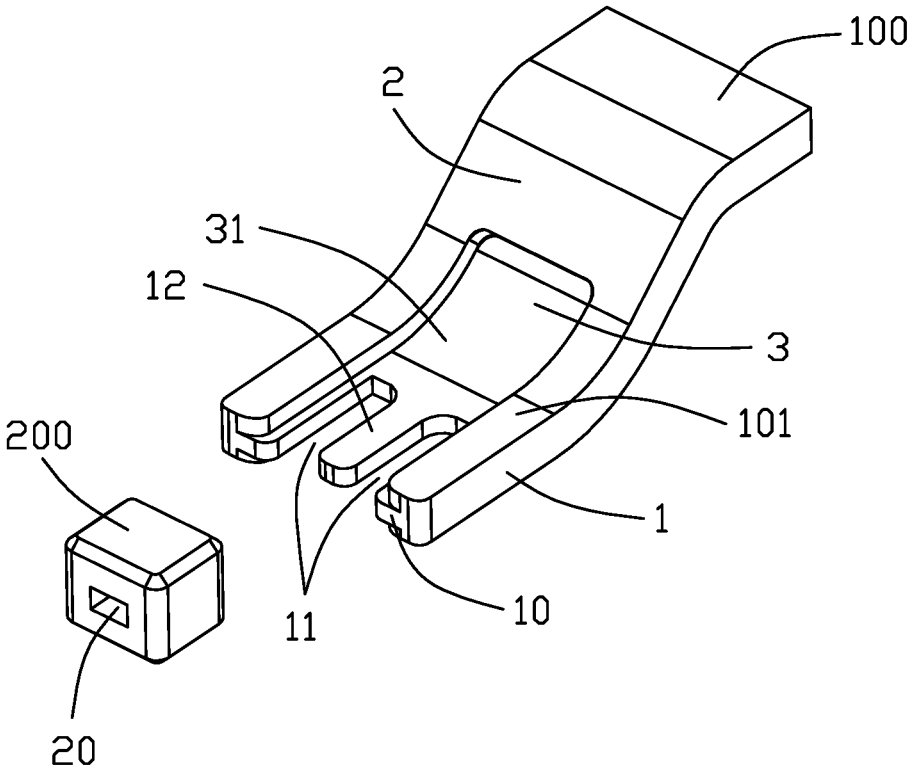
FIG. 8 is an exploded perspective view of the contact and the solder unit of FIG. 7.
Figure 9:
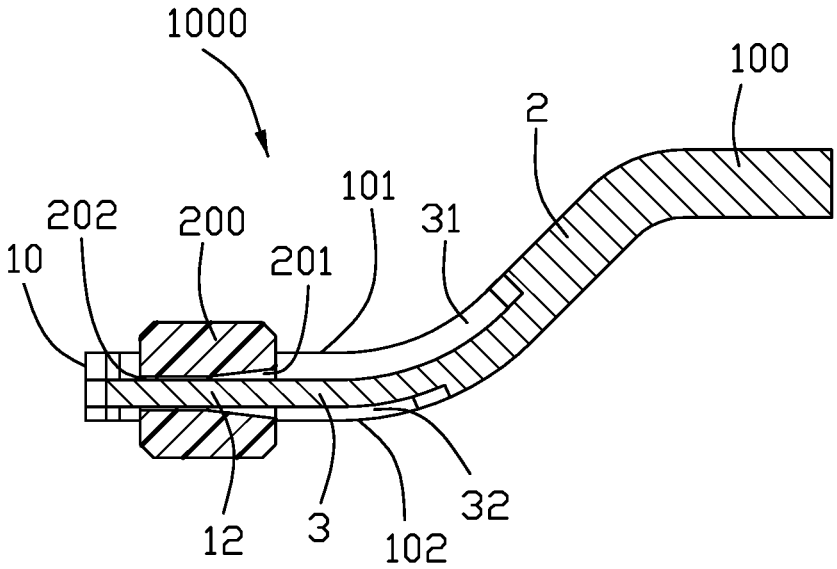
FIG. 9 is a cross-sectional view of the contact and the solder unit of FIG. 7.

Referring to FIGS. 7-9 showing the third embodiment, the securing mechanism 100 includes a contact 100 and the solder unit 200 which is adapted to be melted by laser heating. The contact 100 includes a top surface 101 and the bottom surface 102. The contact includes a mounting section 1 with a free end 10. The mounting section 1 forms a receiving space or securing hole 11 extending through the top surface 101 and the bottom surface 102 and the free end 10. A fixing peg 12 is formed in the receiving space 11, and the solder unit 200 is supportably secured upon the fixing peg 12.

The contact 100 includes a resilient section 2 extending from the mounting section 1. The mounting section 1 extends in a plane while the resilient section 2 extends curvedly and upwardly. The contact 100 forms a first groove 31 in the top surface 101, and a second groove 32 in the bottom surface 102 so as to form therebetween a thinned section 3 extending through the free end 10. The fixing peg 12 is formed on the thinned section 3. The receiving space 11 is narrowed than both the first groove 31 and the second groove 32 in width. Both the first groove 31 and the second groove 32 extend from the mounting section 1 into the resilient section 2. During reflowing, the melted solder unit 200 may flow into the second groove 32 because the mounting section 1 is in a pre-loaded/tensioned manner against the conductive pad 900 (FIG. 3) thereunder of the electrical part (not shown). Notably, the melted solder unit 200 will be restrained within the first groove 31 and the second groove 32 without splashing to contaminate others, The solder unit 200 includes a fixing hole 20 through which the fixing peg 12 extends. The fixing hole 20 has an entrance 201 and an exit 202 wherein the entrance 201 is larger than the exit 202 for facilitating assembling the solder unit 200 upon the fixing peg 12. In this arrangement, on one hand, the solder unit 200 is easily assembled to and reliably secured to the fixing peg 12 before reflowing; on the other hand the solder unit 200 can be efficiently secured to the conductive pad 900 (FIG. 3) after reflowing because the receiving space extends through the top surface 101 and the bottom surface 102 for better fluidity during reflowing.

Figure 10:
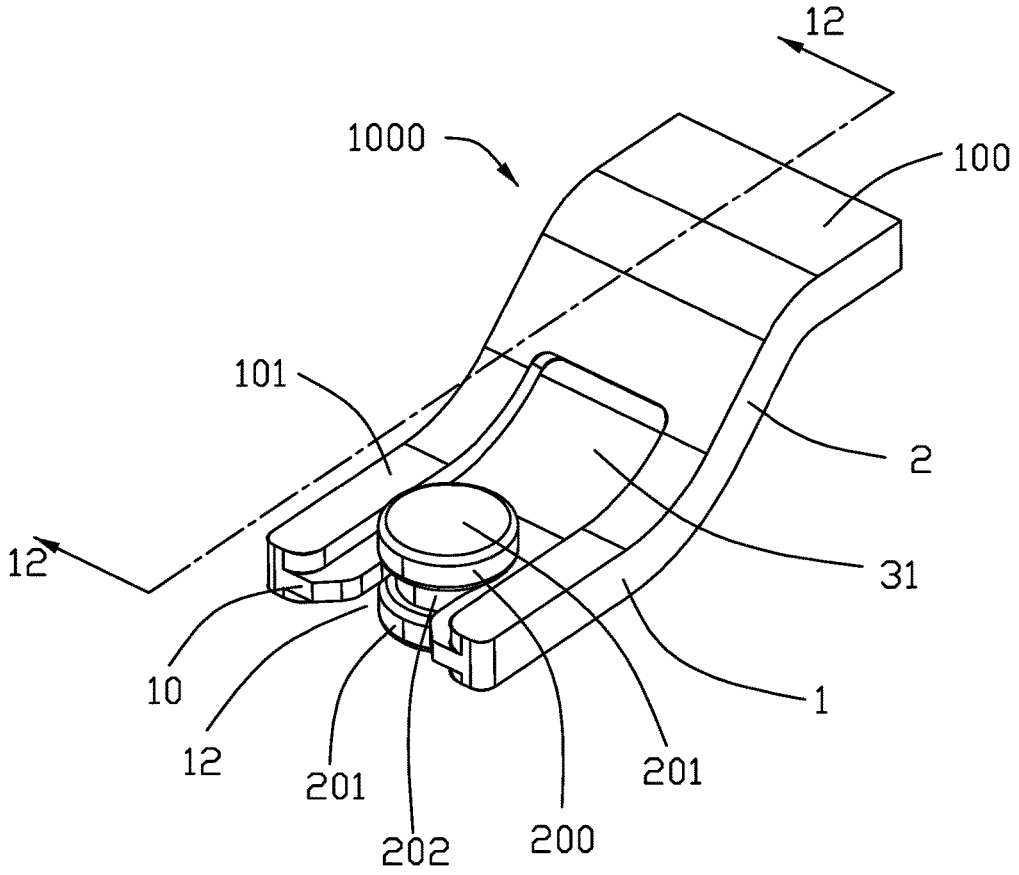
FIG. 10 is an assembled perspective view of the contact and the solder unit according to a fourth embodiment of the invention.
Figure 11:
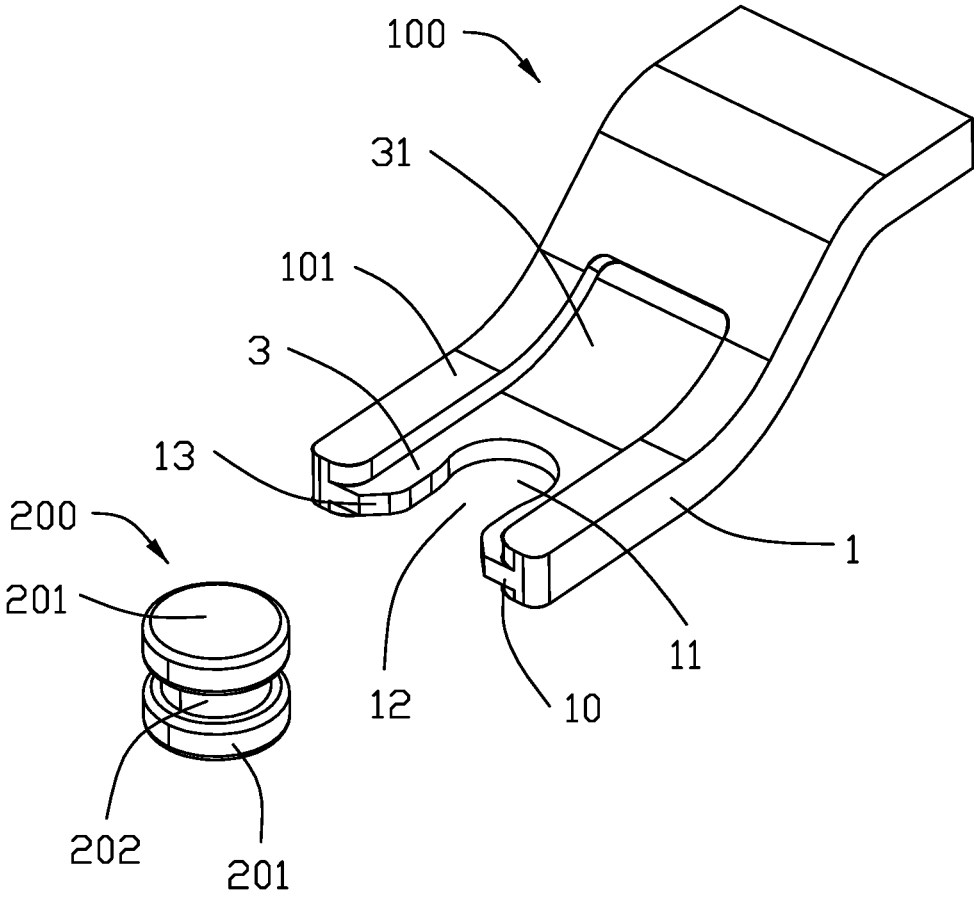
FIG. 11 is an exploded perspective view of the contact and the solder unit of FIG. 10.
Figure 12:
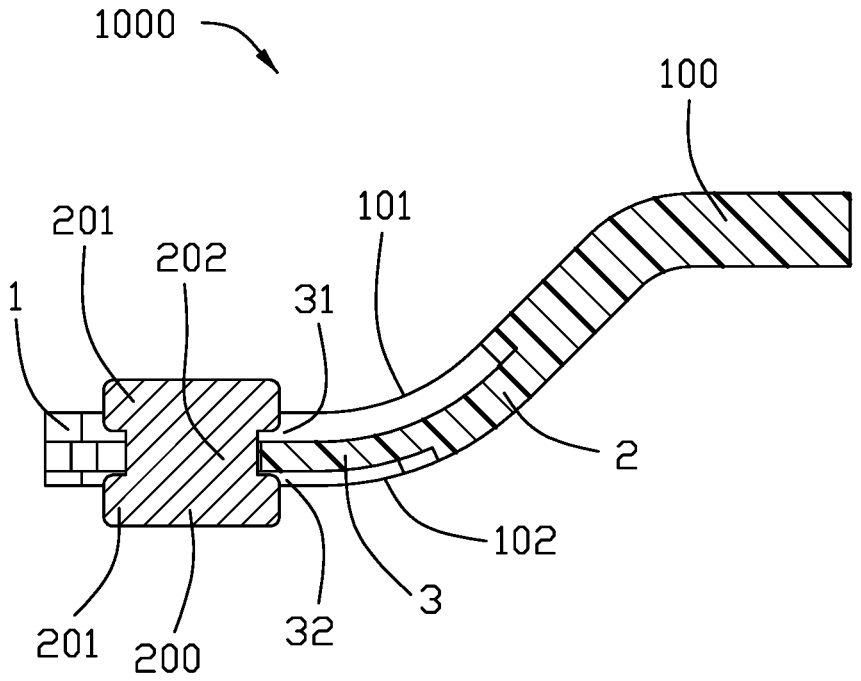
FIG. 12 is a cross-sectional view of the contact and the solder unit of FIG. 10.

Referring to FIGS. 10-12 showing the fourth embodiment, the securing mechanism 100 includes the contact 1 and the solder unit 200. The contact 1 forms the top surface 101 and the bottom surface 102 in a vertical direction, and a mounting section 1 around an end along the front-to-back direction. The mounting section 1 includes a free end 10. A securing hole or receiving space 11 is formed in the mounting section 1 and extends through both the top surface 101 and the bottom surface 102 and the free end 10. A guiding notch 12 is formed in front of the securing hole 11 with an tapered guiding surface 13. The solder unit 200 is retained in the securing hole 11 initially and successively melted and solidified to be secured to the conductive pad 900 (FIG. 3) of a electrical part (not shown). The contact 1 further includes a resilient section 2 extending from the mounting section 1. The mounting section 1 extends in a horizontal plane while the resilient section 2 extends curvedly and obliquely to provide a pressure upon the mounting section 1 in a pre-loaded manner. The contact 100 forms a first groove 31 in the top surface 101, and a second groove 32 in the bottom surface 102 so as to form a thinned section 3 therebetween. The securing hole 11 and the guiding notch 12 extend beyond the thinned section 3 in the vertical direction. Both the first groove 31 and the second groove 32 extend from the mounting section 1 into the resilient section 2. Similar to the third embodiment, during reflowing the solder unit 200 may flow into the second groove 32 smoothly to efficiently secure the mounting section 1 to the conductive pad 900 (FIG. 3) thereunder of the electrical part (not shown). In this embodiment, the solder unit 200 forms an "I" configuration including two opposite heads 201 and a recessed body 202 wherein the body 202 is received within the receiving hole 11, and the two heads 201 are located on opposite sides of the thinned section 3 in the vertical direction so as to prevent moving of the solder unit 200 relative to the contact 100 in the vertical direction. When the solder unit 200 is assembled to the contact 100, the solder unit 200 may move along the guiding surfaces 13 of the guiding notch 12 into the securing hole 11 smoothly. In this embodiment, the width of the joint between the guiding notch 12 and the securing hole 11 is slightly narrower than the securing hole 11 so as to prevent withdrawal of the solder unit 200 from the securing hole 11 toward the guiding notch 12 in the front-to-back direction.

Figure 13:
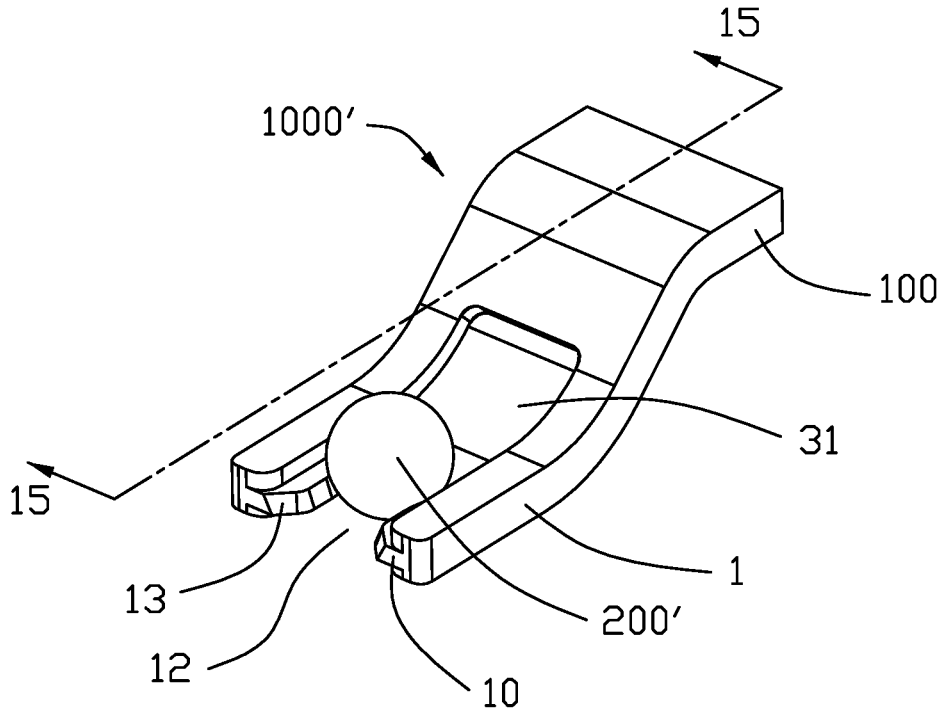
FIG. 13 is an assembled perspective view of the contact and the solder unit according to a fifth embodiment of the invention.
Figure 14:
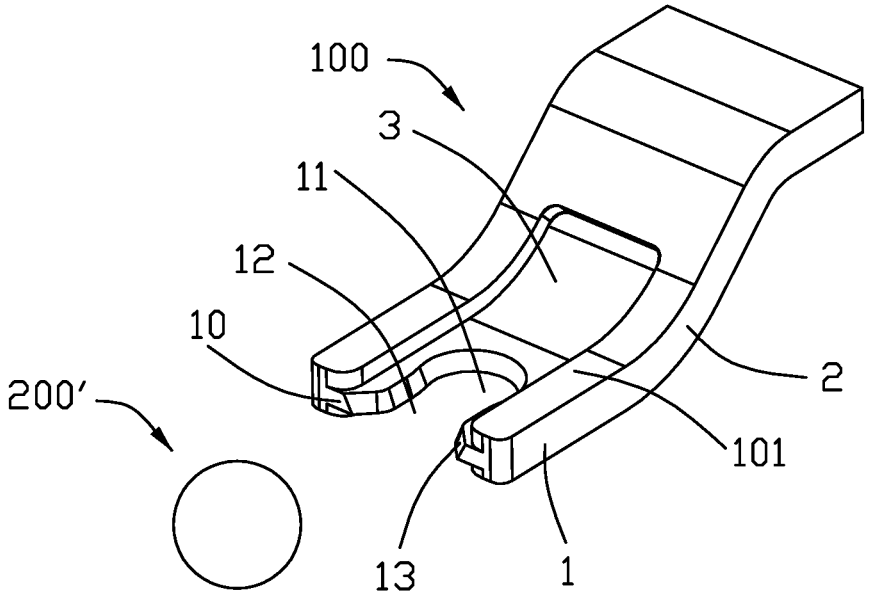
FIG. 14 is an exploded perspective view of the contact and the solder unit of FIG. 13.
Figure 15:
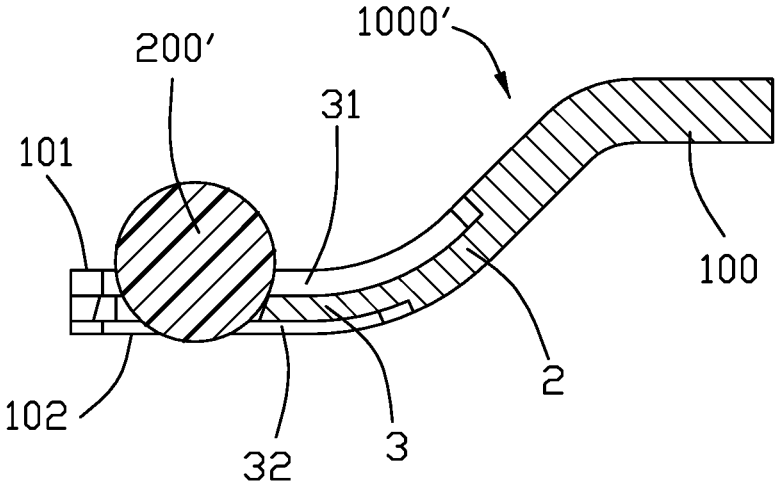
FIG. 15 is a cross-sectional view of the contact and the solder unit of FIG. 13.

Referring to FIGS. 13-15 showing the fifth embodiment, the securing mechanism 1000' includes the contact 100 and solder unit 200' which is different from that in the fourth embodiment even though the contact 100 is same. The solder unit 200' is a ball wherein the diameter of the securing hole is smaller than that of the solder unit 200'. The solder unit 200' extends below the bottom surface of the contact before reflowing. Similar to the fourth embodiment, the width of the joint between the guiding notch 12 and the securing hole 11 is slightly narrower than the securing hole 11 for retaining the solder unit 200' in the securing hole 11. Similar to the fourth embodiment, because of the communicatively joined guiding notch 12 and the securing hole 11, better fluidity of the melted solder unit 200 can be achieved during reflowing.

In brief, the invention is to provide a securing hole extend through the horizontally extending mounting section of the contact in the vertical direction to allow the melted solder unit to extend through the securing hole or receiving space and be simultaneously formed on two opposite top surface and bottom surface of the mounting section so as to efficiently secure the mounting section of the contact and the conductive pad of the electrical part together in the vertical direction. In some embodiments, the solder unit may be securely fixed to the mounting section of the contact before reflowing to allow the contact with the associated solder unit to abut against the conductive pad of the electrical part in pressure for enhancing the later reflowing effect. Understandably, before reflowing, the bottom end of the solder unit may not contact the conductive pad but with a gap therebetween alternately without performing preloading.

What is claimed is:

1. A securing mechanism comprising:

an electrical contact defining opposite top and bottom surfaces in a vertical direction, and a mounting section at a free end in a front-to-back direction perpendicular to the vertical direction;

a securing hole extending through the mounting section in the vertical direction;

a first groove formed in the top surface along the front-to-back direction and communicating with the securing hole;

a second groove formed in the bottom surface along the front-to-back direction and communicating with the securing hole; and a solder unit preliminarily retained to the mounting section and occupying the securing hole for a later reflowing process; wherein both said first groove and said second groove are located beside the securing hole so as to form a thinned section beside the securing hole.

2. The securing mechanism as claimed in claim 1, wherein before the later reflowing process the solder unit has a bottom end extending below the bottom surface.

3. The securing mechanism as claimed in claim 2, wherein the mounting section further includes a guiding notch communicating with the securing hole, and said guiding notch forms a tapered outwardly opening.

4. The securing mechanism as claimed in claim 2, wherein the mounting section includes a fixing peg in the securing hole and the solder unit is attached upon the fixing peg.

5. The securing mechanism as claimed in claim 2, wherein the solder unit is retained to the thinned section.

6. The securing mechanism as claimed in claim 5, wherein the solder unit forms an "I" configuration so as not to move relative to the thinned section in the vertical direction.

7. A securing mechanism comprising:

an electrical contact defining opposite top and bottom surfaces in a vertical direction, and a mounting section at a free end in a front-to-back direction perpendicular to the vertical direction;

a securing hole extending through the mounting section in the vertical direction;

a first groove formed in the top surface along the front-to-back direction and communicating with the securing hole; and a solder unit preliminarily retained to the mounting section and occupying the securing hole for a later reflowing process; wherein said first groove forms a thinned section of the mounting section beside the securing hole.

8. The securing mechanism as claimed in claim 7, wherein the mechanism further includes a second groove below the first groove.

9. The securing mechanism as claimed in claim 8, wherein said second groove is narrower than the first groove.

10. The securing mechanism as claimed in claim 8, wherein the first groove extends through a front end surface of the mounting section while the second groove does not extend through the front end surface of the mounting section.

11. The securing mechanism as claimed in claim 8, wherein the second groove is shorter than the first groove in a front-to-back direction perpendicular to the vertical direction.

12. The securing mechanism as claimed in claim 7, wherein said contact further includes a resilient section linked to the mounting section, and said first groove extends from the mounting section into the resilient section.

13. The securing mechanism as claimed in claim 1, wherein the mounting section is configured and dimension to have the solder unit seated upon the mounting section.

14. The securing mechanism as claimed in claim 1, wherein the first groove extends through a front end surface of the mounting section while the second groove does not extend through the front end surface of the mounting section.

15. The securing mechanism as claimed in claim 1, wherein the second groove is shorter than the first groove in a front-to-back direction perpendicular to the vertical direction.

16. The securing mechanism as claimed in claim 7, wherein the mounting section is configured and dimension to have the solder unit seated upon the thinned section.

17. A securing mechanism comprising:

an electrical contact defining opposite top and bottom surfaces in a vertical direction, and a mounting section at a free end in a front-to-back direction perpendicular to the vertical direction;

a securing hole extending through the mounting section in the vertical direction; and a solder unit preliminarily retained to the mounting section and occupying the securing hole for a later reflowing process; wherein said securing hole communicates with an exterior along the front-to-back direction so as to allow the solder unit to be preliminarily retained to the mounting section along the front-to-back direction.

18. The securing mechanism as claimed in claim 17, wherein the mounting section forms a peg and the solder unit forms a fixing hole receiving said peg.

19. The securing mechanism as claimed in claim 17, wherein the solder unit forms an "I" configuration having two opposite heads commonly sandwiching to the mounting section in the vertical direction.

20. The securing mechanism as claimed in claim 19, wherein a first groove is formed in the top surface and a second groove is formed in the bottom surface so as to commonly form a thinned section sandwiched between the two opposite heads in the vertical direction.

* * * * *